US005365622A

United States Patent [19]

Schirmer

[11] Patent Number: 5,365,622

[45] Date of Patent: Nov. 22, 1994

[54] HYDRAULICALLY OPERATED RETRACTABLE AMBULANCE COT

[76] Inventor: Michael H. Schirmer, 517 Simcoe St. N., Oshawa, Ontario, Canada

[21] Appl. No.: 918,000

[22] Filed: Jul. 24, 1992

[51] Int. Cl.[5] ..... A61G 1/02

[52] U.S. Cl. ..... 5/611

[58] Field of Search ..... 5/611, 625, 11; 296/20

[56] References Cited

U.S. PATENT DOCUMENTS

| | | | |
|---|---|---|---|
| 2,538,993 | 1/1951 | Travis | 5/611 |
| 3,099,020 | 7/1963 | Garfield et al. . | |
| 3,174,722 | 3/1965 | Alm | 5/611 |
| 3,815,164 | 6/1974 | Smith . | |
| 4,078,269 | 3/1978 | Weipert | 5/611 |
| 4,097,941 | 7/1978 | Merkel . | |
| 4,675,926 | 6/1987 | Lindblom et al. | 5/611 |
| 5,022,105 | 6/1991 | Catoe | 5/611 |
| 5,054,141 | 10/1991 | Foster et al. | 5/611 |
| 5,083,331 | 1/1992 | Schnelle et al. | 5/611 |
| 5,135,350 | 8/1992 | Eelman | 296/20 |
| 5,271,113 | 12/1993 | White | 296/20 |

FOREIGN PATENT DOCUMENTS

| | | | |
|---|---|---|---|
| 777660 | 2/1968 | Canada . | |
| 837803 | 3/1970 | Canada . | |
| 1040550 | 10/1978 | Canada . | |
| 1125952 | 6/1982 | Canada . | |
| 1266752 | 3/1990 | Canada . | |
| 1262031 | 4/1961 | France | 5/611 |
| 1274324 | 5/1972 | United Kingdom | 5/611 |

*Primary Examiner*—Michael Milano

*Attorney, Agent, or Firm*—Cushman, Darby & Cushman

[57] ABSTRACT

A retractable collapsible hydraulically operated ambulance cot having an upper frame with a bed for patient support; a lower frame; an intermediate frame disposed between and cooperable with the upper frame and the lower frame; a frame support pivotally connected to the upper frame, lower frame and the intermediate frame, which supports the upper frame and allows separation of the upper frame from the lower frame at a selected height of the upper frame above the lower frame; and adjustable retaining means cooperable with the frame support to retain the upper frame at the selected height. The cot is highly user friendly in allowing one or two ambulance attendants to easily transfer the cot into and out of the rear of an ambulance.

13 Claims, 11 Drawing Sheets

FIG. 11
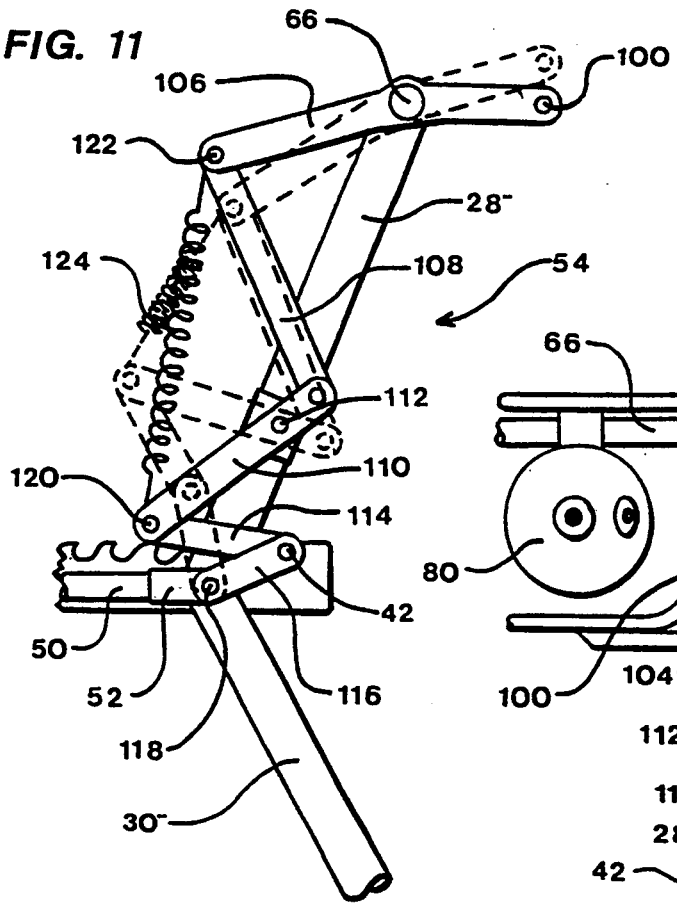
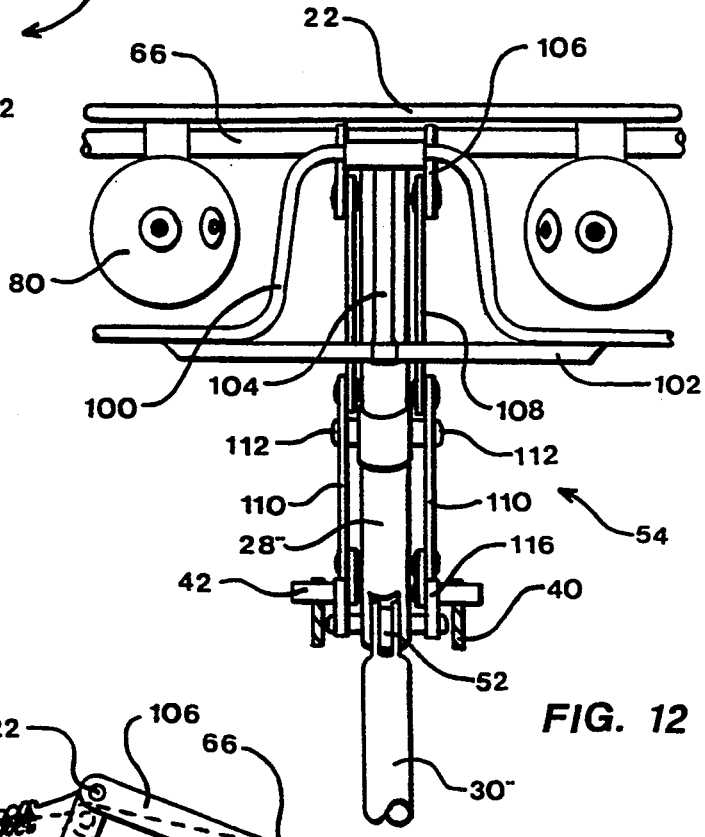
FIG. 12
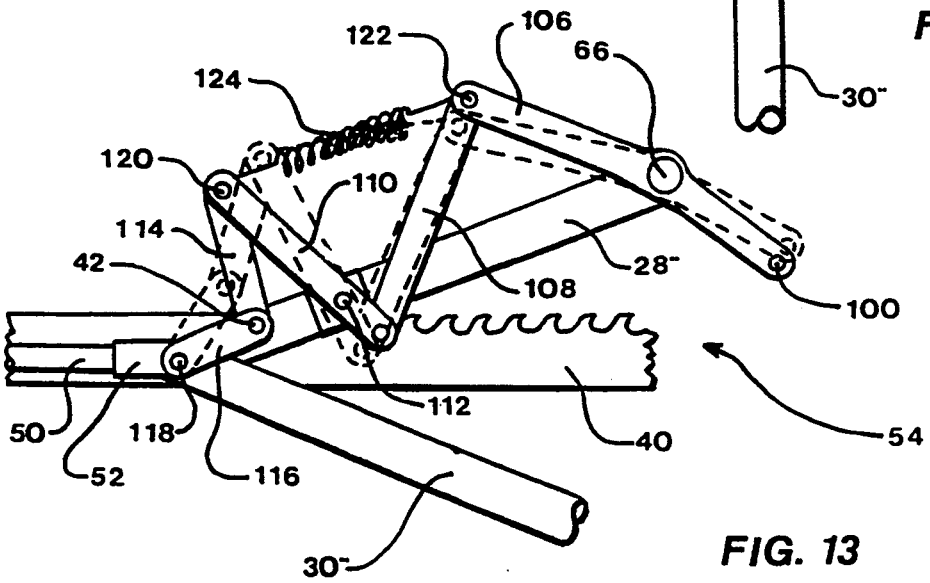
FIG. 13

HYDRAULICALLY OPERATED RETRACTABLE AMBULANCE COT

FIELD OF THE INVENTION

This invention relates to ambulance cots and more particularly to ambulance cots having hydraulically, particularly pneumatically, operated collapsible frame structures to facilitate manual operation by a single operator from the ground into an ambulance.

2. Description of the Prior Art

Ambulance attendants frequently sustain back injuries as a direct result of their work requirements. These injuries lead to a substantial amount of lost work time as well as considerable therapeutic costs. As current ambulance cots are designed to be fully manually operated, they present significant problems for the ambulance personnel.

In order to raise a cot loaded or unloaded, the attendants must lift the cot from a relatively low height of approximately 15 cm from the ground to a height of almost 1 meter. Unfortunately, they are required to initiate the lift in a rather awkward position, making themselves highly susceptible to obtaining a back injury or exacerbating an existing one.

It is estimated that this problem costs the health care systems in North America in excess of one hundred million dollars annually in lost work time alone, and an additional amount in therapeutic costs. This estimation is based on the following parameters. In Canada, the present average annual salary for an ambulance attendant is approximately $38,000.00 and roughly $24,000 in the United States. During the attendants' absence from work caused by sickness or work related injuries, between 60% and 90% of their salaries are paid for, on average. Based on surveys performed in several major cities in Ontario, Canada, as well as from medical statistics, it is believed that over one half of the ambulance attendants' lost work time is directly attributed to back injuries resulting from operational requirements of current stretchers. It should also be noted that the ambulance departments are frequently obligated to pay overtime to obtain temporary replacements for attendants on sick leave.

However, this problem should not only be viewed upon from the perspective of monetary costs, but consideration should also be given to the human pain derived from these injuries. Based on surveys and statistics, it is estimated that an individual in this profession will only be an ambulance attendant until an average age of 35 years old. At this time, the attendants will have suffered from numerous work related injuries. In fact, many attendants are forced to prematurely end their careers as a direct result of back injuries.

Since there are approximately eight attendants for each stretcher in service (2 per shift, 4 shifts per week), the benefits derived from one improved stretcher would be distributed amongst eight attendants, decreasing both lost work time and therapeutic costs as well as offering improved working conditions.

In appreciating the problems existing in current cot designs, the need for a greatly improved stretcher has clearly been defined.

In designing a new ambulance stretcher it is crucial that certain requirements of the unit be satisfied. The overall dimensions in terms of maximum and minimum height, length, width, and the like of the new design should not greatly differ from those of existing cots; unless they are considered to be an improvement. An example of such an improvement would involve reducing the overall minimum length of the stretcher to make the unit easier to maneuver in tight areas, such as elevators and stairwells. Furthermore, it is advantageous that the weight of the stretcher be reduced to an absolute minimum, without sacrificing any structural strength. This may be achieved, for example by the use and implementation of new materials and advanced engineering techniques.

Another equally important condition to be satisfied is to have high reliability for the unit, in addition to maintaining a high level of comfort and security for the patient.

Finally, the unit must be economically and commercially viable as well as technically feasible.

Satisfying these requirements is almost mandatory for an ambulance cot to be accepted into the medical community.

Known prior art stretchers which may be pertinent to this invention are as follows: U.S. Pat. No. 4,097,941, Jul. 4, 1978; U.S. Pat. No. 3,815,164, Jun. 11, 1974; U.S. Pat. No. 3,099,020, Jul. 30, 1963; Canadian Patent No. 1,266,752, dated Mar. 20, 1990; Canadian Patent No. 1,125,952, dated Jun. 22, 1982; Canadian Patent No. 1,040,550, dated Oct. 17, 1978; Canadian Patent No. 837,803, dated Mar. 31, 1970; and Canadian Patent No. 777,660, dated Feb. 6, 1968.

None of these known prior art devices provides the novel and advantageous features of the present invention disclosed herein.

SUMMARY OF THE INVENTION

An object of the present invention is to provide an ambulance cot which is highly user friendly by the implementation of a mechanism which allows attendants to raise and lower the cot with virtually no exertion on their backs.

It is a further object of the present. invention to provide an ambulance cot which is easily transferable into and out of the rear of an ambulance.

It is a yet further objective of the present invention to provide an ambulance cot which may be raised or lowered by a single attendant.

The invention provides in a general sense a cot having an intermediate frame having pivotally connected support members to support an upper frame of the cot having patient support means above the undercarriage and which intermediate frame and pivot arrangement facilities ease of retraction and opening of the cot when associated supports are pivotally pressed apart or brought together by means of a hydraulically, preferably pneumatically, activated cylinder piston means and retained in a selected position by retaining means.

Accordingly, the invention provides in its broadest aspect a collapsible ambulance cot comprising:

an upper frame having patient support means;

a lower frame;

an intermediate frame disposed between and cooperable with said upper frame and said lower frame;

support means to support said upper frame and allow separation of said upper frame from said lower frame to a selected height of said upper frame above said lower frame; and adjustable retaining means cooperable with said support means to retain said upper frame at said selected height.

Preferably the support means comprises a frame support pivotally connected to said upper frame, said lower frame and said intermediate frame. More preferably, the frame support comprises at least one pair of pivotal frame support members, each of said frame support members displaced one from the other of said frame support member and pivotally connected to said upper frame, lower frame and said intermediate frame relative one to the others, and to provide support to said upper frame.

In one embodiment of the cot according to the invention the frame support members comprises a collapsible pivotal X-frame. Preferably, the frame support comprises at least two pairs of pivotal frame support members. However, in a yet more preferred embodiment the cot comprises a first pair of said pivotal frame support members, a second pair of said pivotal frame support members and a third pivotal frame support member, wherein each of said first pair, said second pair and said third frame support members are so disposed as to provide support to said upper frame; and wherein each of said pivotal frame support members comprises (a) a first elongated member pivotally connected (i) at an upper part thereof to said upper frame and (ii) at a lower part thereof to said intermediate frame; and (b) a second elongated member pivotally connected (i) at an upper part thereof to said intermediate frame and (ii) at a lower part thereof to said lower frame.

Preferably, the adjustable retaining means operable with the support means to retain the upper frame at its desired height, comprises a fluid actuated cylinder and piston means, preferably a pneumatically operated cylinder and piston means. The adjustable retaining means further comprises in a preferred embodiment means for locking the frames at a desired height by use of a ratchet and pin retaining means or lockable telescopic tube means, each of which are operable with the cylinder and piston.

More preferably, the cylinder and piston means is manually controllable by valve means which activate pressurized fluid, preferably air, acting within the cylinder against the piston.

Yet more preferably, the valve means comprises a first valve means to effect piston expansion of said cylinder and piston means to effect raising of said upper frame above said lower frame; a second valve means to effect movement of said upper frame or said lower frame one towards the other, to effect either lowering of said upper frame to said lower frame, or, raising of said lower frame to said upper frame when said upper frame is maintained at a selected height above the ground; and a third valve to effect exhaustion of fluid from said cylinder.

In a further feature, the cot according to the present invention further comprises a plurality of patient support boards hinged one board to another board wherein said hinges are bonded to said boards by means of a cured structural epoxy adhesive.

Further objects and advantages of this invention will become subsequently apparent.

BRIEF DESCRIPTION OF THE DRAWINGS

In order that the invention may be better understood, a preferred embodiment will now be described, by way of example only, with reference to the accompanying drawings, wherein like numerals refer to like parts and wherein:

FIG. 11 is a schematic side elevational view of a multiple-bar spring return locking mechanism of use in the cot according to the invention;

FIG. 12 is a partial end view of a lock mechanism of use in the cot according to the invention in an elevated position;

FIG. 13 is an alternative side elevational view of the lock mechanism depicted in FIG. 11, wherein the upper frame is in a contracted position with respect to the lower frame;

DESCRIPTION OF PREFERRED EMBODIMENTS

Figure 1:
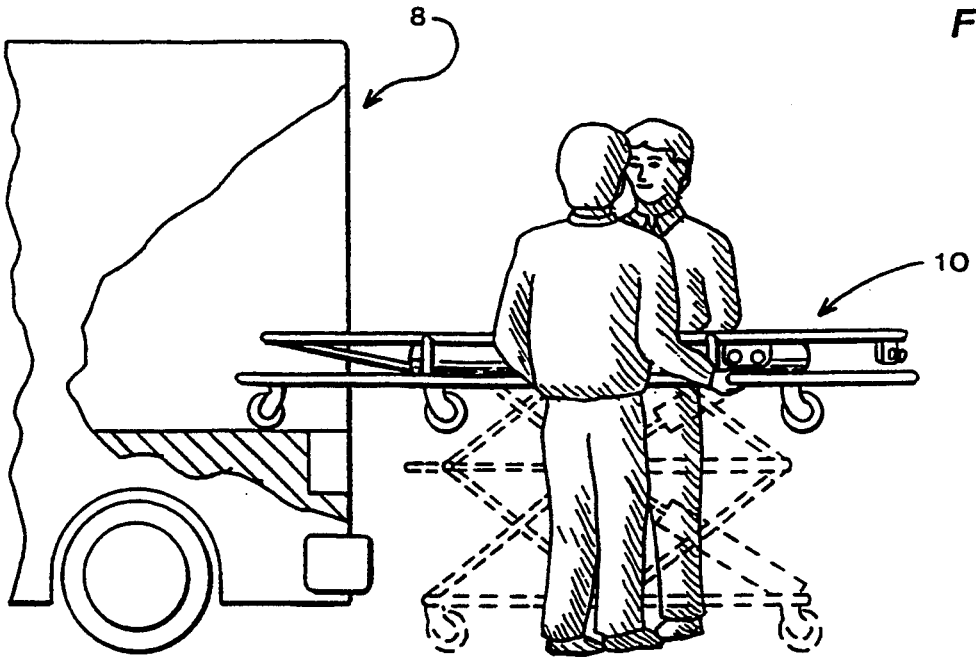
FIG. 1 is a pictorial view of the cot according to the invention retracted and raised in use by attendants.

With reference to FIG. 1, this shows an ambulance 8 into which is loaded a retractable ambulance cot of this invention shown generally as 10 and upon which a patient (not shown) may be supported. The loading of cot 10 is by the disposition of two attendants standing one along each of the sides of the cot.

Figure 2:
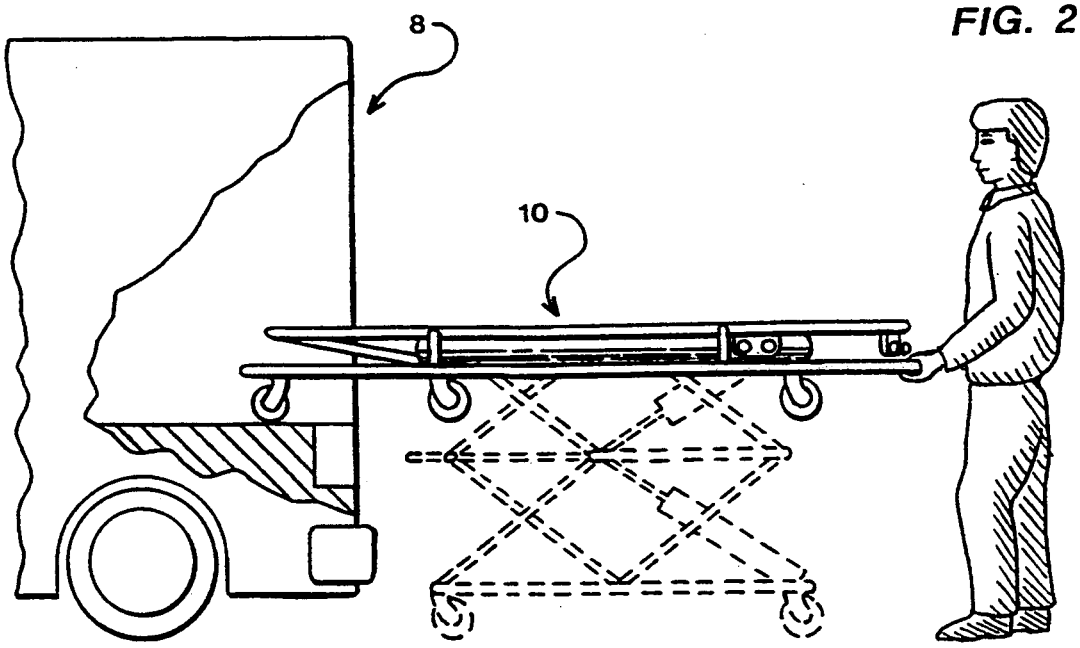
FIG. 2 is a pictorial view of the device according to the invention raised in an alternative manner.

FIG. 2 shows a single attendant holding and manipulating the rear of the cot while resting the fore end of the cot in the rear of the ambulance. Operation of an associated valve system of the cot as hereinafter described causes the undercarriage to be pneumatically raised to the level of the ambulance floor to allow the attendant to transfer the cot into the ambulance.

With particular reference to FIGS. 3–6, cot 10 comprises an upper frame shown generally as 12, a lower frame or undercarriage shown generally as 14 and a centrally disposed intermediate frame shown generally as 16, support means shown generally as 18 and adjustable retaining means shown generally as 20. Upper frame 12 has patient bed 22 upon which a patient rests and lower frame 14 has a set of swivel wheels 24.

Figure 4:
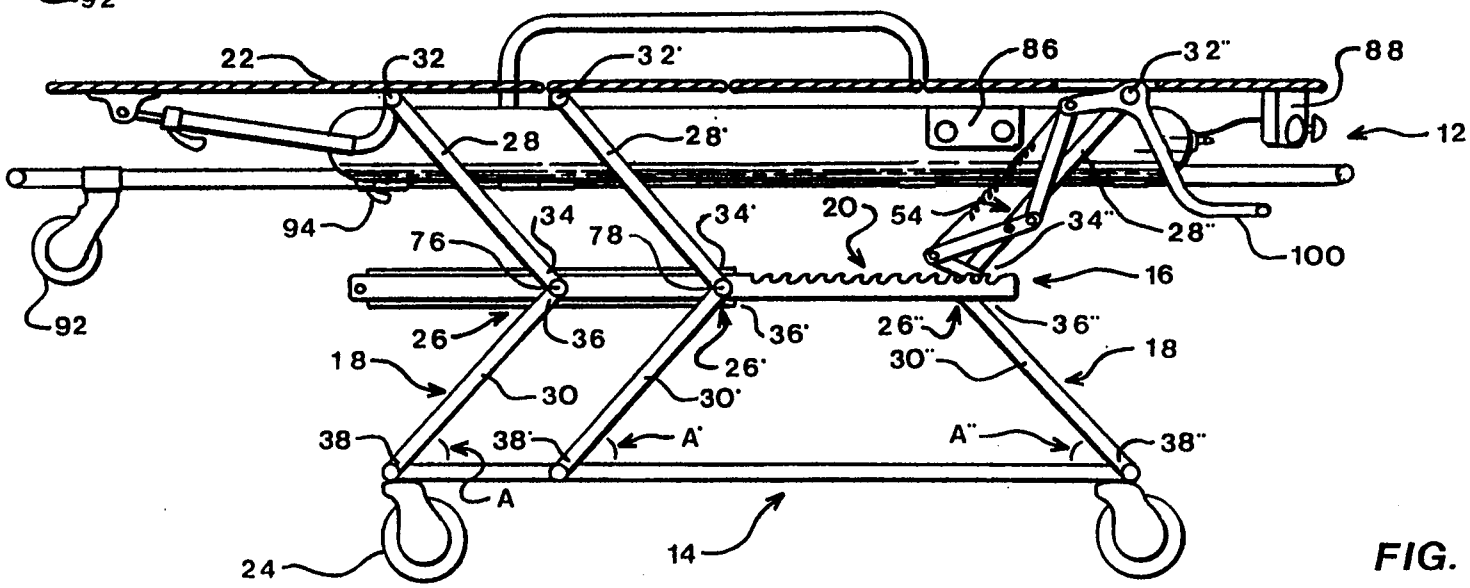
FIG. 4 is a schematic view in side elevation of a cot according to the invention in an open non-retracted position.

With particular reference to FIG. 4, support 18 in the embodiment shown comprises frame supports 26 and 26', on each side of cot 10 and frame support 26" central of cot 10, pivotally connected to upper frame 12, lower frame 14 and intermediate frame 16.

Each of the frame support members 26, 26' and 26" comprises an upper elongated member 28, 28' and 28", respectively, and a lower elongated member 30, 30' and 30", respectively.

Thus, the preferred embodiment shown comprises a first pair of pivotal frame support members 26, a second pair of pivotal frame support members 26' and a third pivotal frame support member 26" wherein each of the frame support members is pivotally mounted to upper frame 12, intermediate frame 16 and lower frame 14, such that upper elongated members 28, 28' and 28" are pivotally connected at an upper part 32, 32' and 32" respectively, to upper frame 12 and at a lower part 34, 34' and 34", respectively, to intermediate frame 16. Lower elongated members 30, 30' and 30" are pivotally connected at an upper part 36, 36' and 36" respectively, to intermediate frame 16 and pivotally connected at a lower part, 38, 38' and 38" respectively, to lower frame 14.

As viewed in FIG. 4, upper elongated members 28 and 28' in conjunction with horizontal parts of upper frame 12 and intermediate frame 16 define a parallelogram configuration. Similarly, lower elongated members 30 and 30' with intermediate frame 16 and lower frame 14 define a parallelogram configuration. In the embodiment shown, elongated members 28", 30" of support member 26" are pivotally connected centrally of and to intermediate member 16 and upper and lower frames 12, 14 as to project away from members 28, 28', 30 and 30' of the pairs of support members 26, 26'. Furthermore, the angle A made between elongated member 30 and lower frame 14 is equal to angle A' made between elongated member 30' and lower frame 14. More importantly, this angle A' is equal and opposite to the angle A" made between elongated member 30" and lower frame 14; hence, elongated members 30' and 30" and lower frame 14 form the base portion of an isosceles triangle. Upper frame 12, lower frame 14 and intermediate frame 16 define with elongated arms 28, 28', 30 and 30' a double parallelogram configuration; one parallelogram being a mirror image of the other about intermediate member 16. In addition, the graphical configuration defined by elongated members 30, 30', and 30" and lower frame 14 is also a mirror image of elongated members 28, 28', and 28" and upper frame 12, about the intermediate frame 16.

Figure 10:
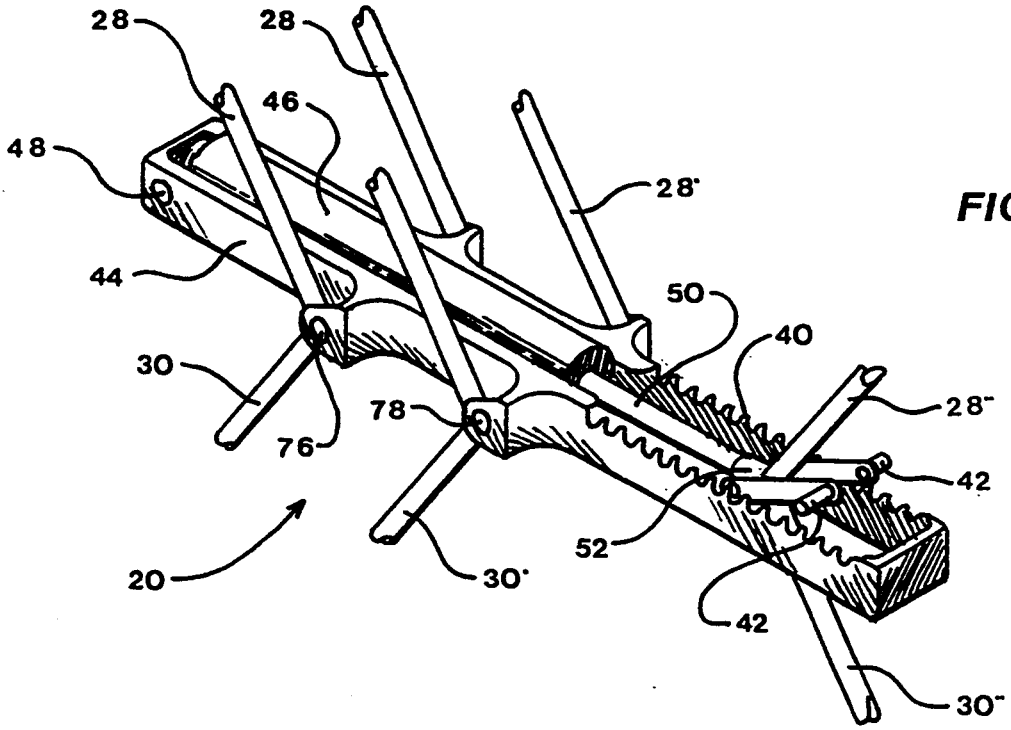
FIG. 10 is a perspective view of an intermediate frame member having adjustable retaining means of use in the cot according to the invention.
Figure 14:
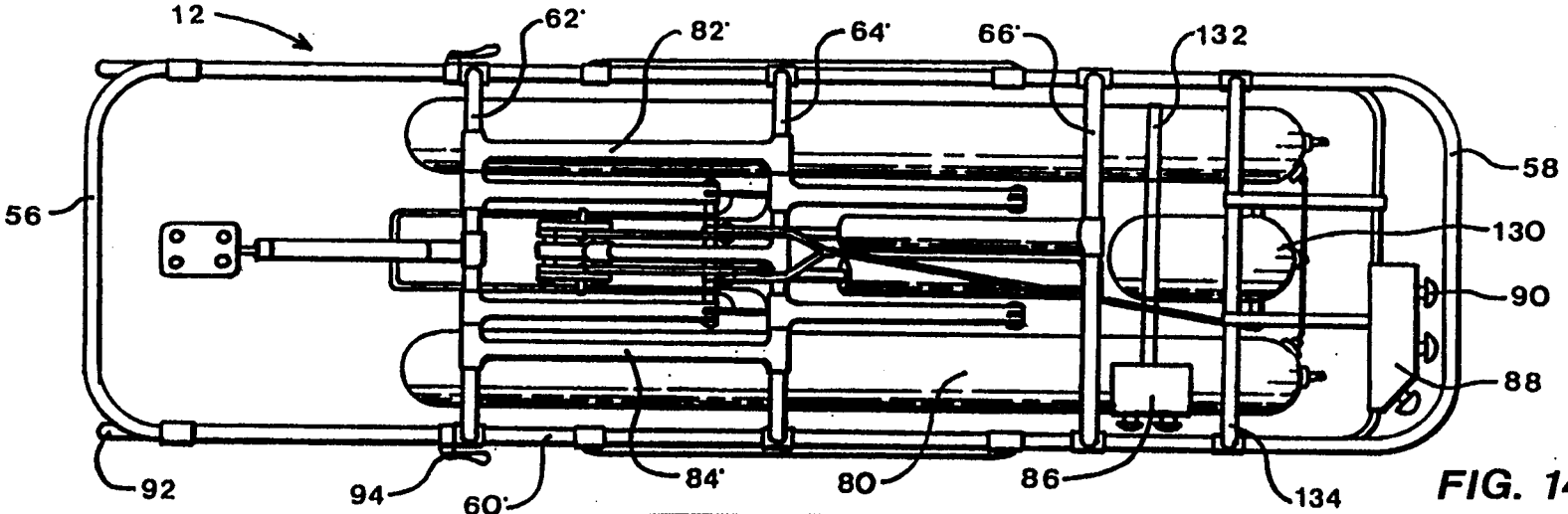
FIG. 14 is a schematic top view of the upper structural portion of a cot according to the invention having two pneumatic lift cylinders.

With particular reference to FIG. 4 and FIG. 10, rectangular open-block intermediate frame 16 is constituted at one half 40 as a serrated ratchet rack upper surface which acts as a ratchet mechanism for receiving retaining pins 42 of a ratchet and disposed within part 40 of intermediate frame 16. Remaining half 44 of intermediate frame 16 retains a cylinder 46 and piston rod 50 system actuated by a pressurized fluid, compressed air in the embodiment shown, such that the piston rod 50 cooperates with clevis mount 52, pivotally connected to elongated members at 34", 36", to effect horizontal movement of the ratchet and pin means in conjunction with a multiple bar spring return locking means shown generally as 54 in FIG. 11.

Figure 3:
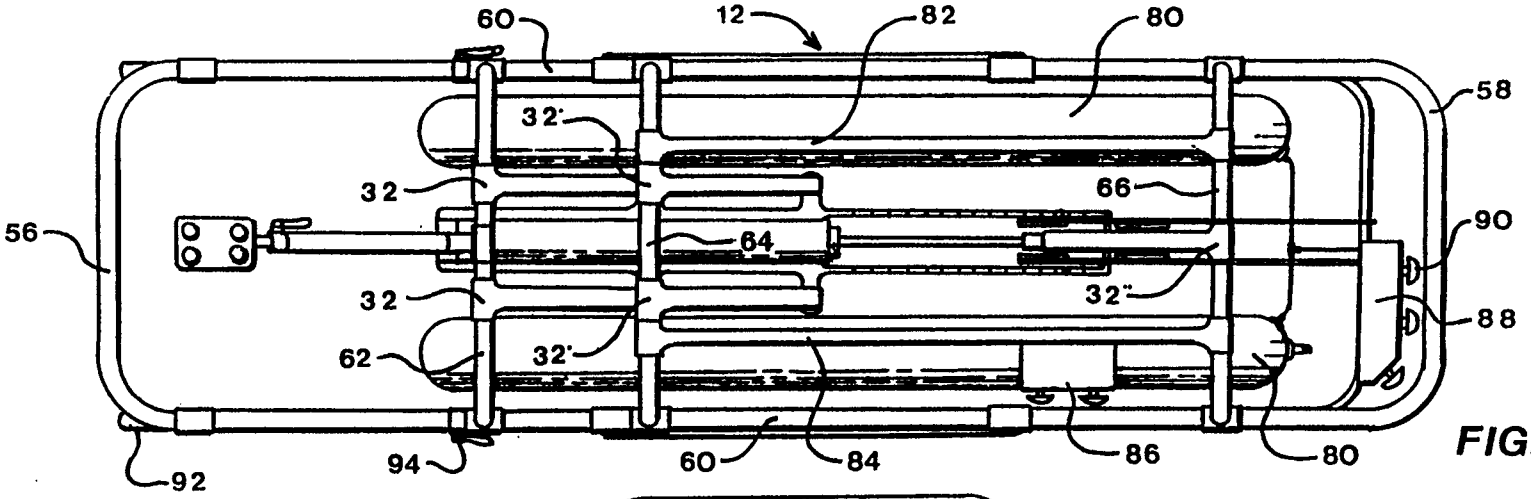
FIG. 3 is a schematic top view of the upper structural portion of a cot according to the invention.

Furthermore, as shown in FIG. 3, open, rectangular upper frame 12, comprises front and rear telescopic handles 56 and 58, respectively, which telescope within side tubes 60. Upper frame 12 gains rigidity from frame members 62, 64 and 66 affixed perpendicularly to side tubes 60. Members 62 and 64 also act as upper pivot points for elongated members 28 and 28'. Member 66 acts as the upper pivot point for elongated member 28".

Figure 5:
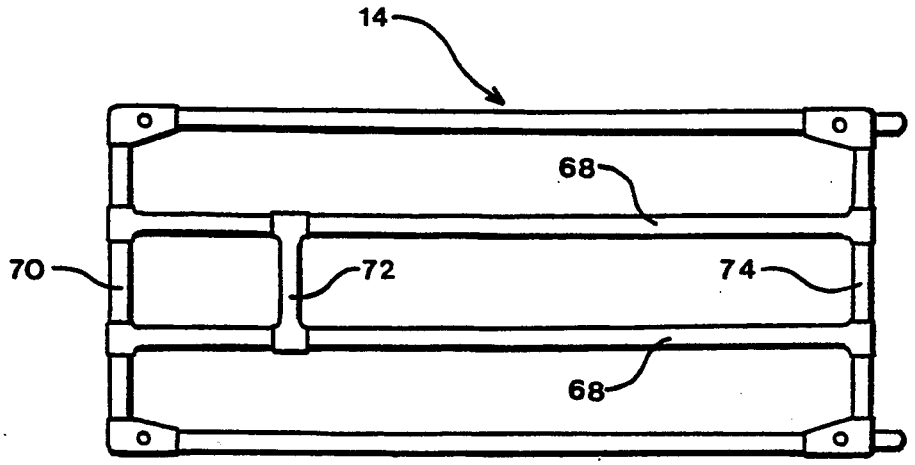
FIG. 5 is a schematic top view of the undercarriage of a cot according to the invention.

As shown in FIG. 5, open, rectangular lower frame 14 has a pair of longitudinal inner support members 68, front transverse member 70, intermediate transverse member 72 and rear transverse member 74 to provide rigidity to undercarriage 14. Members 70 and 72 provide lower pivot point areas for elongated members 30 and 30', respectively. Similarly, transverse member 74 provides the lower pivot area for elongated member 30".

With particular reference to FIGS. 4 and 10, pneumatic cylinder casing 44 has pivot point 76 for elongated members 28 and 30, and pivot point 78 for elongated members 28' and 30'. The significant advantage provided by cylinder casing 44 is that it allows the pneumatic cylinder 46 to be pivoted at the end of casing 44 at point 48 while allowing casing 44 to be pivoted at points 76 and 78 with respect to elongated members 28, 30 and 28' 30' respectively, thereby assisting to substantially decrease the length of the undercarriage.

With reference to FIG. 10, it can be seen that the cylinder-piston arrangement pivots from the rear of the cylinder while simultaneously allowing intermediate frame 16 to be pivoted from a location as close to the front of the cylinder as possible, such that the overall length of the lower frame is maintained as a minimum.

Piston rod 50 has clevis mount 52 which provides a pivot point for elongated members 28" and 30". Upper end of elongated member 28" is pivotally connected to structural frame member 66 and the lower end of elongated member 30" is pivotally connected to transverse member 74 on undercarriage 14. The distance between transverse members 70, 72 and 74 is fixed and equivalent to the distance between transverse members 62, 64 and 66, respectively. Upon expansion of cylinder 46, angle A (FIG. 4) is increased to cause the cot to elevate. Due to the double parallelogram configuration described hereinabove, the patient bed on upper frame 12 will remain parallel to undercarriage 14 at all times. Furthermore, the patient's bed will rise and fall in a perpendicular direction to the undercarriage, providing the clearly advantageous feature of the double parallel elongated members configuration. It should also be noted that elongated members 28, 28', 28", 30, 30' and 30" are all of an identical center to center (distance between pivot points at either end) length.

With particular reference to FIG. 3, attached to transverse members 62 and 66 within upper frame 12 are pneumatic pressure vessels 80 which store compressed air required to operate the new cot according to the invention. Pressure vessels 80 are, typically, recharged once per shift (approximately every eight hours) at an ambulance station via a standard air compressor taking approximately one to two minutes to refill. In the case of an emergency, they could also be refilled via a small air compressor on board the ambulance, or via a standard gas station air pump.

Upper frame 12 has lateral stabilizer bars 82, 84 to provide additional support for the patient bed surface 22. In addition, member 84 and a side tube member 60 retains a side-operated pneumatic valve system 86, which contains a 3-position four-way pilot controlled valve operated by two sets of control valves wherein each set is separated by a shuttle valve (not shown) to allow independent operation of the valves, as hereinafter described. These valves are used to pressurize and exhaust either end of pneumatic cylinder 46. An additional exhaust valve is installed in valve system 86 to allow cylinder 46 to be retracted under a load on the cot by exhaustion of the pressurized air in cylinder 46. Any vacuum in the opposite end of cylinder 46 is eliminated by a one-way check valve. Further, upper frame 12 has an end valve system 88, attached to rear telescopic handle 58, which contains two of the control valves which may also be used to pressurize either end of cylinder 46. Valve system 88 is provided with a manual override valve installed between a pilot controlled valve and the pressure source. When activated, the manual override valve in conjunction with the exhaust valve of system 86 allows all air in cylinder 46 to escape to the atmosphere. This permits the cot to be operated manually in virtually the same fashion as current cots are operated. End valve 90 of valve system 88 is provided as a manual override valve should any malfunction occur in the pneumatic system, i.e. due to a ruptured line, a damaged valve, and the like. The override is achieved by engaging valve 90 in conjunction with engaging the exhaust valve on valve system 86 in order to exhaust all pressurized air from the piston and cylinder arrangement, thereby allowing the cot to be raised and lowered manually in a similar fashion as seen in current ambulance cots of the prior art.

Figure 9:
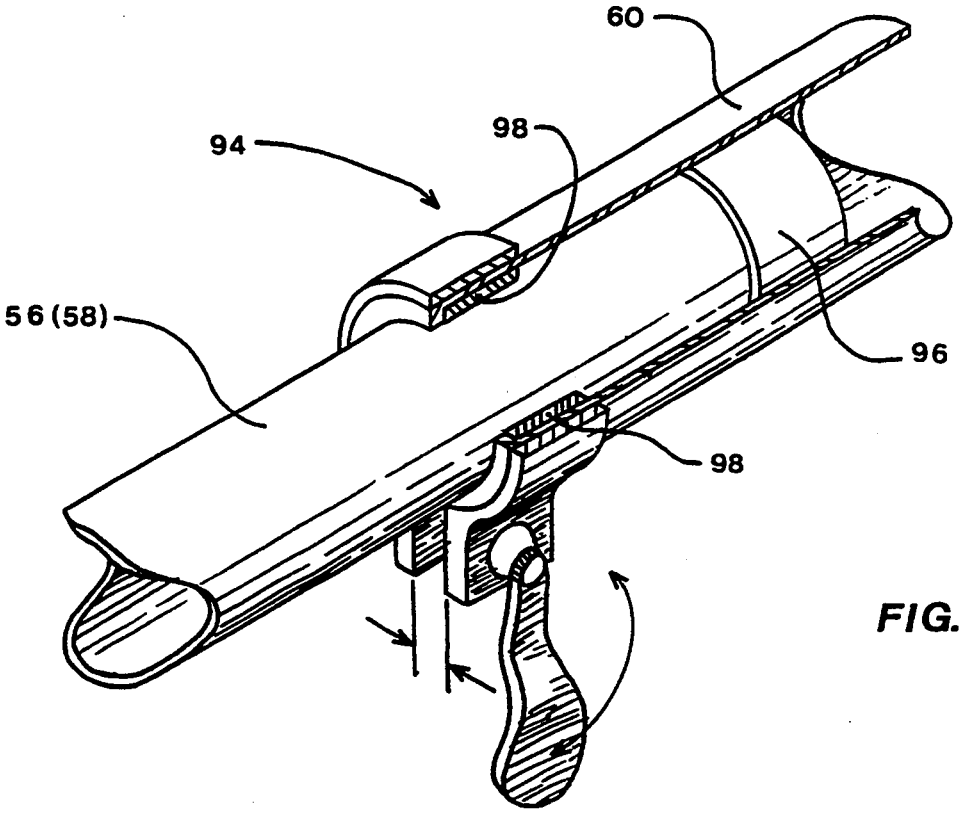
FIG. 9 is a perspective view, partly cut-away, depicting a locking telescopic tube assembly of use in the cot according to the invention.

On the end of front telescopic handle 56 is mounted a small wheel assembly 92, which is used to aid in transferring the cot into and out of ambulance 80. During this action, telescopic handle 56 is fixed in position relative to upper frame 12 by means of a telescopic quick release lock mechanism shown generally as 94 in FIGS. 3 and 9.

As an additional safety feature during the action of transferring cot 10 into ambulance 8 as depicted in FIG. 2, telescopic handles 56 and 58 are prevented from sliding out of side tube members 60 in case locked mechanism 94 should not be engaged. This achieved by a bushing 96 (FIG. 9) fixed to each of the ends of the telescopic handles 56 and 58 within side tube members 60, and an additional slotted bushing 98 is fixed within each end of side tube members 60, whereby the extension of telescopic handles 56 and 58 is limited as bushing 96 butts against bushing 98. Adequate tolerances exist between bushings 98 and telescopic handles 56 and 58, and between side tube members 60 and bushings 96, thereby reducing resistances between sliding surfaces. Bushings 96 and 98 would typically be made of a nylon or teflon type material. As an additional safety feature, the front wheels of wheel assembly 92 ride on one way bearings allowing only one way rotation of the wheels thereby preventing the cot from rolling backwards off the end of the ambulance.

With reference to FIGS. 4, 11, 12 and 13, a detailed description of a preferred lock mechanism is provided.

This mechanism allows the cot to be adjusted to a number of different height positions. In order to engage the lock mechanism at a particular height, pressure in cylinder 46 is released from and by valve systems 86 or 88. Simultaneously, depression of bar 100, reinforced by members 102 and 104, by an attendant causes elongated bar member 106 to rotate clockwise about transverse member 66. This in turn pulls up on elongated arm 108 to cause elongated arm 110 to rotate counterclockwise about pivot point 112, which causes elongated bar member 114 to force member 116 to rotate clockwise about clevis pin 118, which is the pivot point of elongated members 28" and 30" and clevis mount 52. Hence, as upper frame 12 is lowered due to the pressure in cylinder 46 being either released or re-directed via valve system 86 or 88, lock pin 42, located at the outer end of member 116, slides into a notch of ratchet rack 40 thereby locking the cot in a desired height position. Retained between pivot points 120 and 122 is a tension spring 124 which causes a return force on the action described above. Accordingly, by raising the cot slightly by means of valve systems 86 or 88, the lock mechanism described above is automatically disengaged due to the return force caused by spring 124. It should be noted that the cot may be adjusted to virtually an infinite number of height positions using only the hydraulic or pneumatic system comprising primarily valve systems 86 and 88, cylinder 46, and pressure vessels 80. However, since all hydraulic and pneumatic cylinders lose pressure as a function of time, a hydraulically or pneumatically set height position may only be maintained under load conditions for a period of approximately 15 to 20 minutes.

Figure 6:
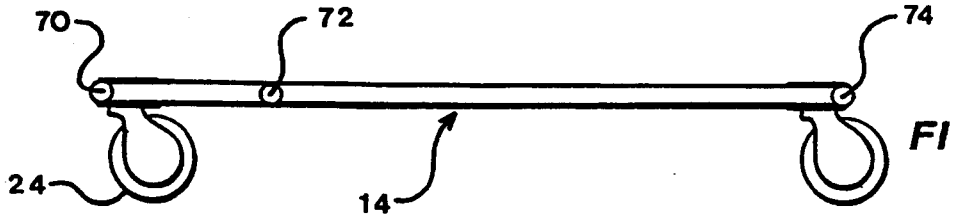
FIG. 6 is a schematic side elevational view of the under carriage of a cot according to the invention.
Figure 7:
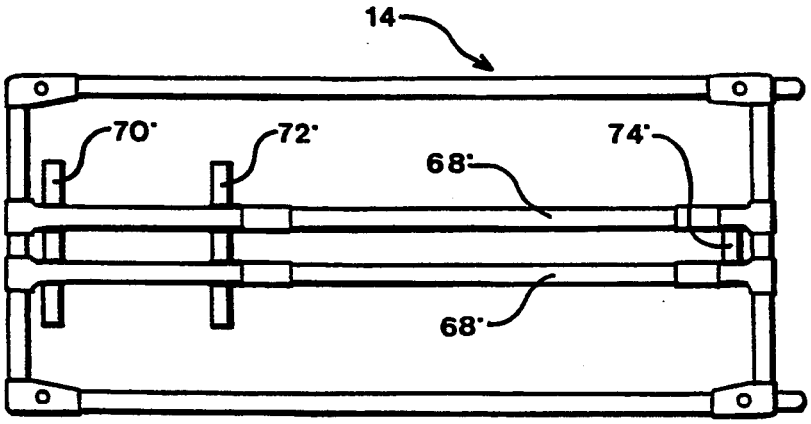
FIG. 7 is a schematic top view of the undercarriage of a cot according to the invention having an alternative protruding pivot assembly to that depicted in FIG. 5.
Figure 8:
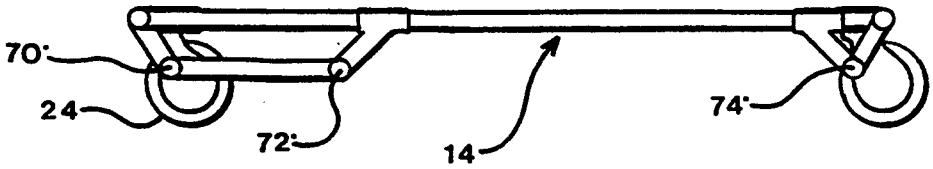
FIG. 8 is a schematic side elevational view of the under carriage of the cot depicted in FIG. 7.

FIGS. 7 and 8 show an alternative design to the undercarriage of that shown in FIGS. 5 and 6. The lower frame system of FIG. 7 and 8 provides for transverse members 70', 72' and 74' analogous to 70, 72 and 74 of FIG. 5 to protrude approximately 7.5 cm below members 68' analogous to member 68. Such an arrangement allows the minimum angle of A to be greater than that of the undercarriage depicted in FIG. 5 and FIG. 6. This reduces the power required in cylinder 46 to initiate the lift of upper frame 12 and intermediate frame 16, thereby allowing more cycles to be obtained per refill of pressure vessels 80.

An alternative cot according to the invention is shown with reference to FIGS. 14, 15, 16 and 17. The major modification of this embodiment to that described hereinbefore is that two pneumatic cylinders 126 and 128 are used rather than single cylinder 46. This not only eliminates the need for cylinder casing 44 but also reduces the power requirements for the pneumatic cylinders to lift the cot. Furthermore, it also allows the length of the undercarriage to be reduced substantially, which provides the cot with improved maneuverability. Yet further, an additional pressure vessel 130 fastened to pressure vessels 80 via connectors 132 and 134, is present which increases the volume of available pressurized air, thereby increasing the number of cycles obtainable per charge of vessels 80.

Figure 19:
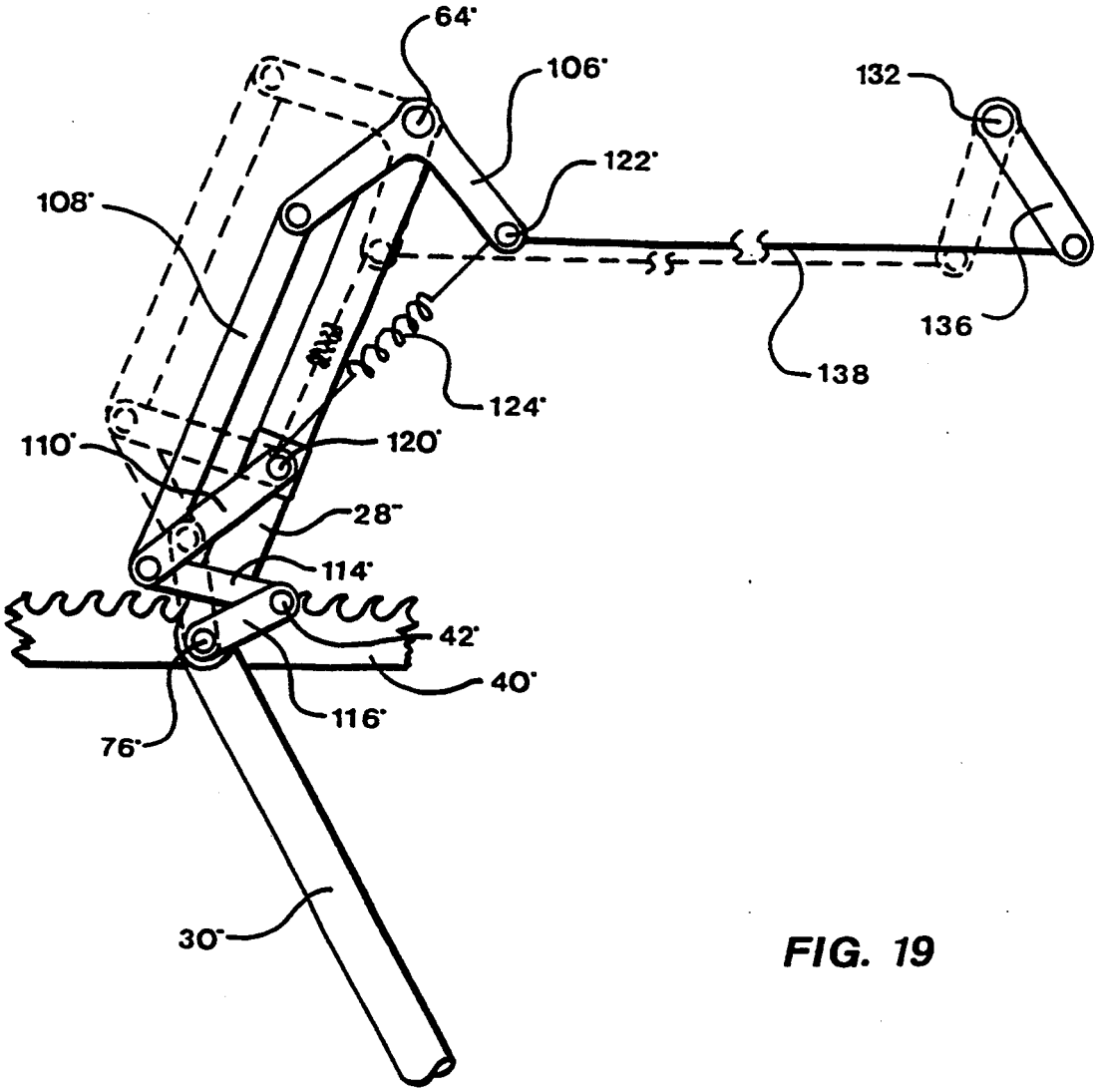
FIG. 19 is a schematic side elevational view of a multiple-bar spring return lock mechanism of use in the cot according to the invention depicted in FIGS. 14 to 18.

The adjustable retaining means is also similar to that described previously. With reference to FIG. 19, the primary difference is that elongated members 28'' and 30'' are not in contact with the clevis mounts 52' of the cylinders, but mainly by pivot points, or pin, 76', which is analogous to 76 in FIG. 4. 76' also acts as the pivot connection of the intermediate frame 16 for elongated members 28 and 30, not shown in FIG. 19 for simplicity of the drawing. Similarly, 78' is the intermediate frame pivot point for elongated members 28' and 30'. The end of cylinder 126 pivots on 66' and the end of cylinder 128 pivots on 72''. The clevis mounts 52' of both cylinders meet at 76'.

By engaging, i.e. pushing up 100' while lowering the cot using valve systems 86 or 88, member 136 is rotated counterclockwise about 132 causing member 106' to also move counterclockwise about 644' and member 110' to move counterclockwise about 120' through 94' applying a pushing force upon it. Therefore, member 114' causes member 116' to rotate clockwise about 76'. Again, while the cot is being lowered, pin 42' will slide and lock into a notch of rack 40'. Either lock mechanism described above provides the cot with a valuable locking height adjustment in increments of approximately 2.5 cm.

Figure 15:
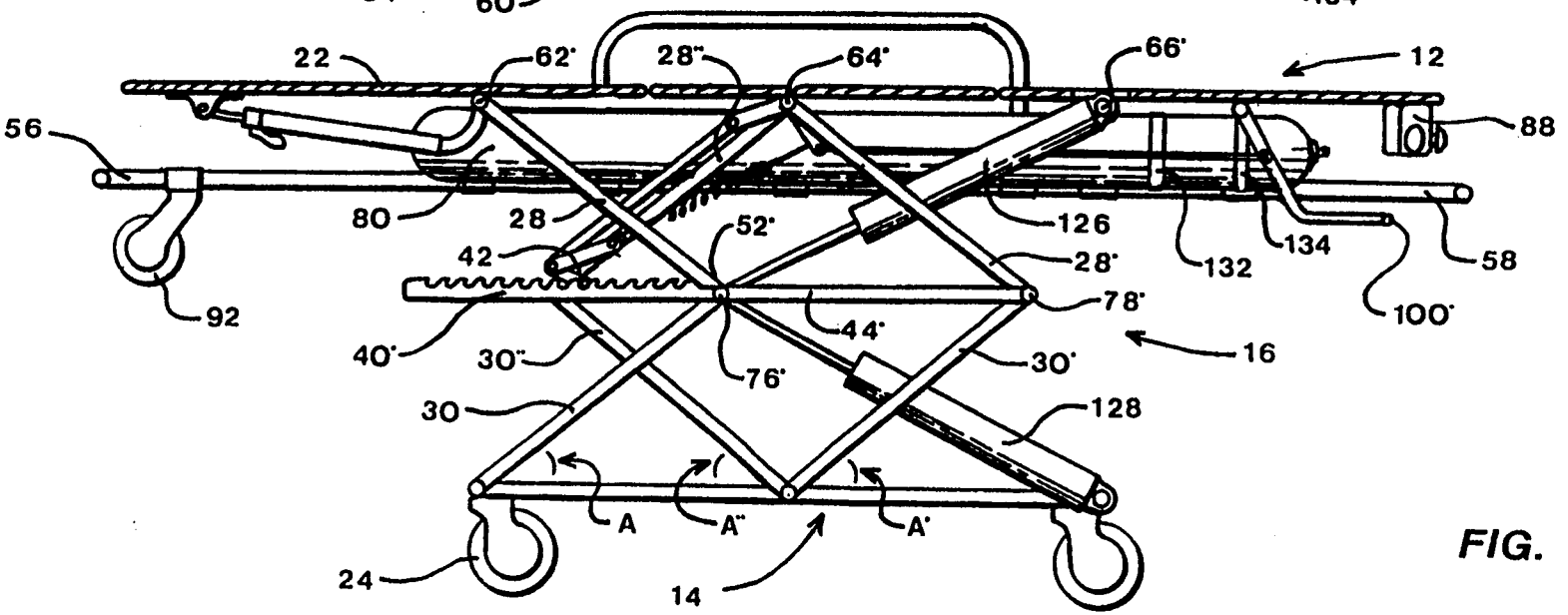
FIG. 15 is a schematic side elevational view of a cot according to the invention having two pneumatic lift cylinders.
Figure 16:
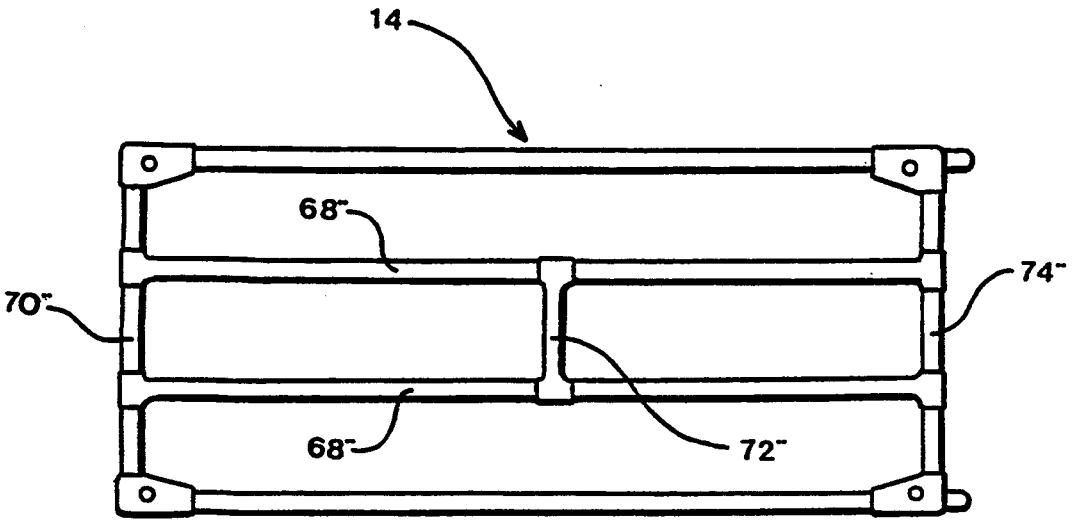
FIG. 16 is a schematic top view of the undercarriage of a cot according to the invention depicted in FIGS. 14 and 15.
Figure 17:
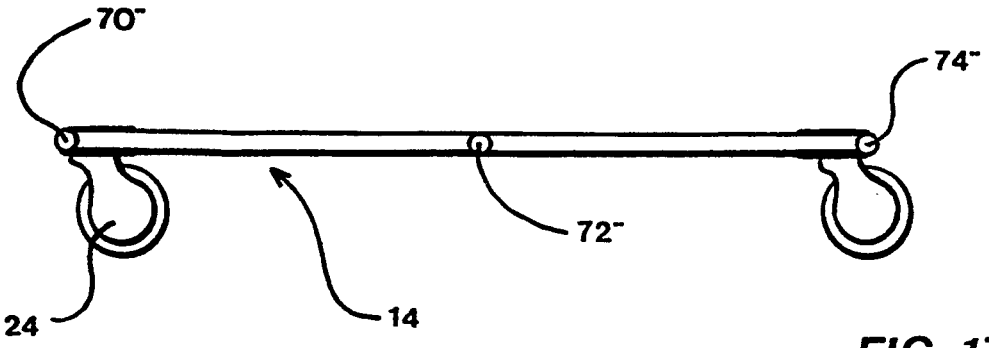
FIG. 17 is a schematic side elevational view of the undercarriage depicted in FIG. 16.

Due to the decrease in the distance between members 70'' and 74'' of the undercarriage, as compared to the alternative design depicted in FIGS. 5 and 6, the modified cot design of FIGS. 14–17 is slightly less stable, but more maneuverable. As shown in FIG. 15, cylinder casing 44 of FIG. 10 has been replaced by longitudinal member 44'. Further, lateral stabilizing members 82' and 84' on the upper frame have replaced members 82 and 84, respectively, of FIG. 3. The pneumatic system operates in essentially the same manner, with the only difference being that there are two cylinders connected in parallel rather than a single cylinder.

Figure 18:
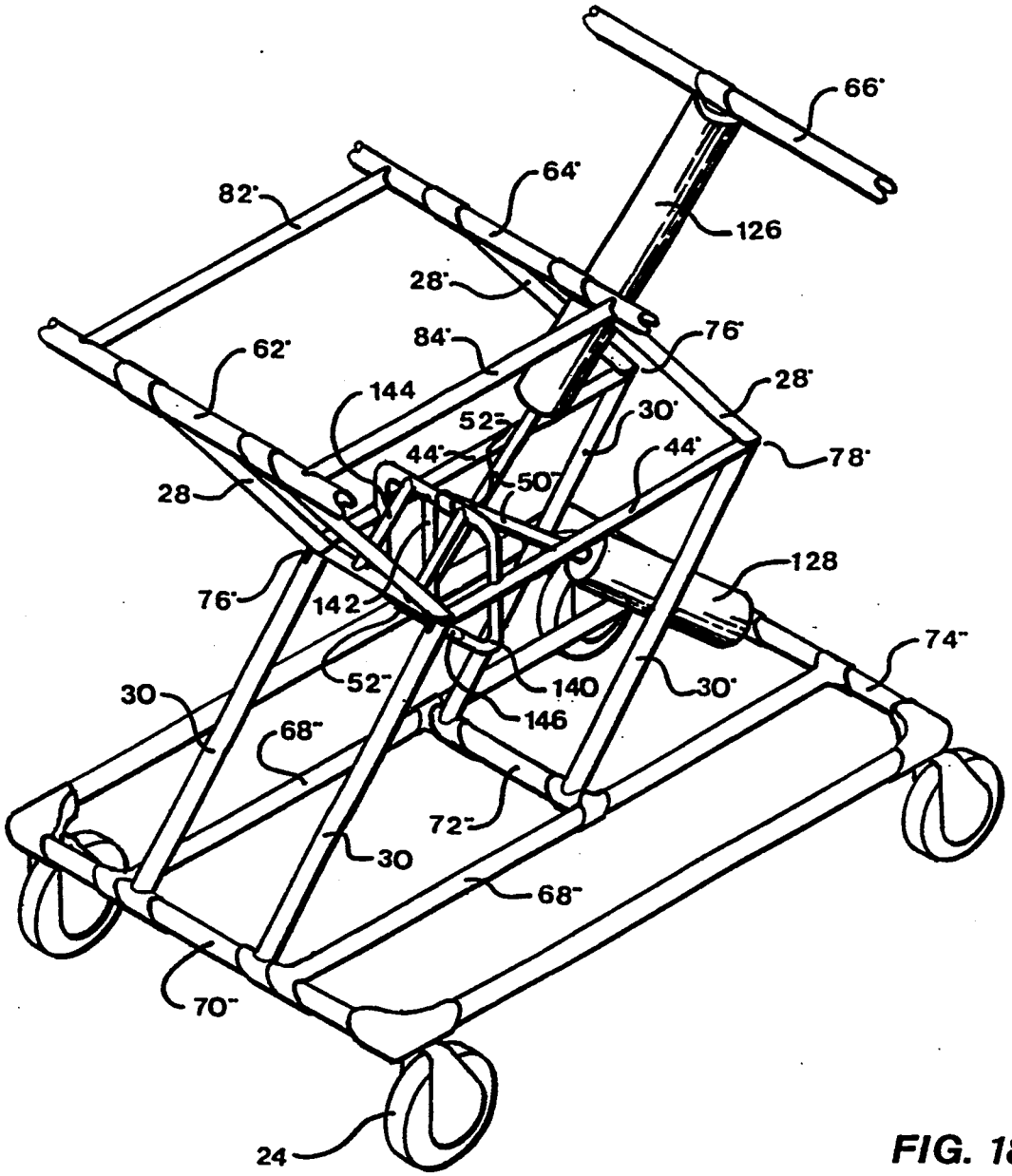
FIG. 18 is a perspective view, in part, showing a modification to the lifting mechanism depicted in FIG. 14 and FIG. 15.

FIG. 18 shows an alternative cot frame work according to the invention. In this modification, cylinders 126 and 128 essentially cross the frame work such that cylinder 128 pivots between lower frame member 74'' and the upper portion of vertical rectangular frame member 140; and cylinder 126 pivots between upper frame member 66' and the lower portion of 140. 140 allows the cylinders 126 and 128 to pivot, yet separates their clevis mounts by a vertical distance of approximately 15 cm in the embodiment shown. This arrangement further requires less power, provided by the pneumatic cylinder, to initiate the lift. Member 140 is essentially a tubular square frame mounted vertically at its center on either side to members of intermediate frame 44', reinforced by vertical member 142 and diagonally connected to member 76' from an upper part and bottom part of 140 by diagonal members 144 and 146, respectively. This arrangement ensures that the above described assembly remains fixed relative to intermediate frame member 44'.

Figure 22:
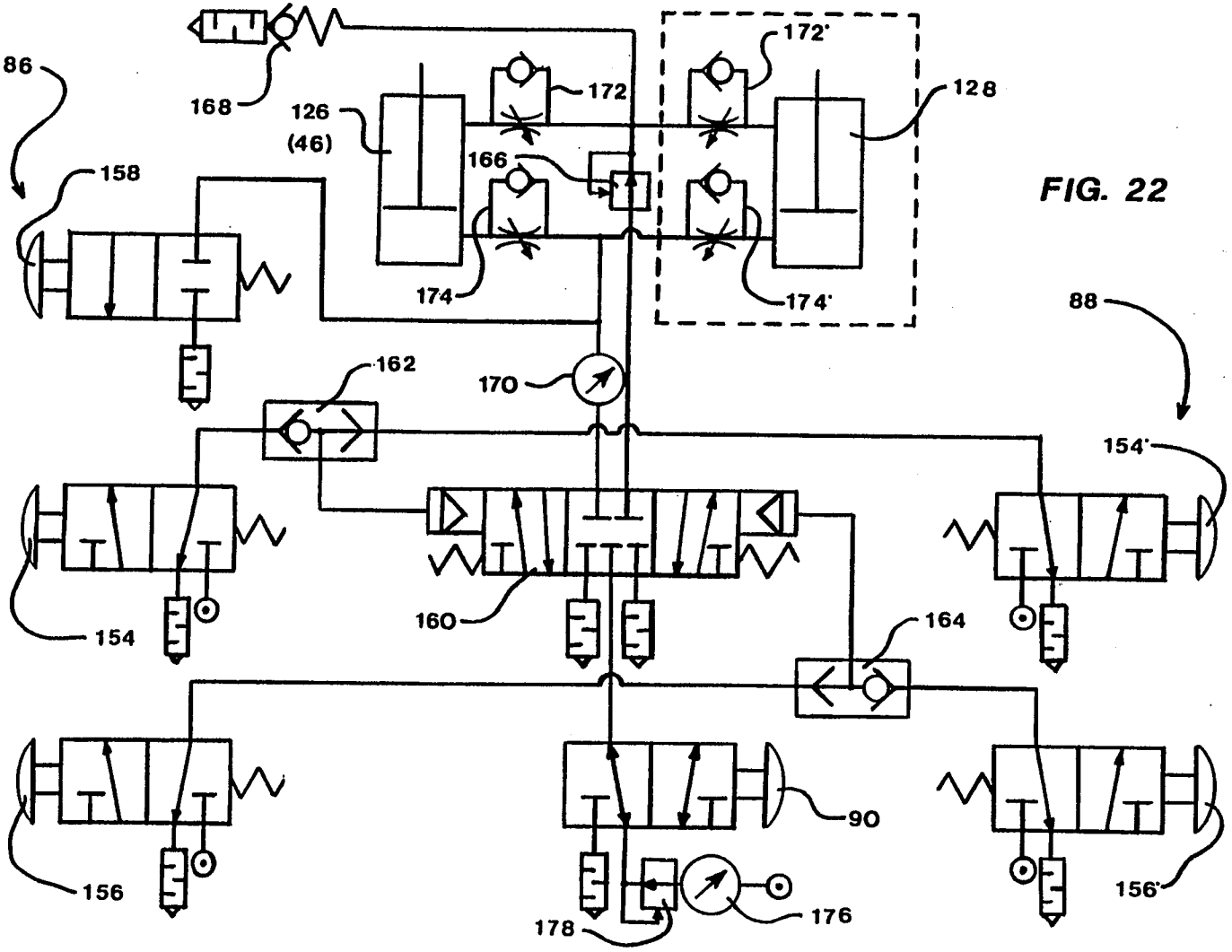
FIG. 22 is a schematic layout representation of a pneumatic system of use in the cot according to the invention.

With reference particularly to FIG. 22, the valve system located at side 60 of cot 10 and denoted generally as 86, comprises operating valves 154, 156, and 158, pilot controlled valve 160, shuttle valves 162 and 164, regulator valve 166, and check valve 168. The rear valve system of cot 10, denoted generally as 88, comprises operating valves 154' and 156', manual override valve 90, and system operating pressure gage 170. The system may contain one cylinder 46, or two cylinders 126 and 128. The functionality of the system is practically the same in either case.

The action of raising cot 10 (upper frame 12 relative to lower frame 14 and intermediate frame 16) may be achieved by pushing either valve 154 of valve system 86, or 154' of valve system 88 by pushing either one of these 3-way, 2-position, spring return valves, pressurized flow, generally from pressure vessels 80, is routed through shuttle valve 162 causing the 4-way, 3-position, spring centered pilot controlled valve 160 to be engaged. This in turn allows regulated pressurized flow from the source (the pressure vessels) to pass through the normally disengaged, manual override, 3-way, 2-position detent valve 90, through valve 160 and into the bottom of cylinder 46 (or cylinders 126 and 128, as the case may be). The speed of the cylinder(s) expanding is governed by flow control valve 172 (or 172 and 172'); therefore, the rate at which cot 10 rises is governed directly by the flow control valve(s). Fluid, air in this embodiment, from the upper portion of the cylinder(s) is metered out through the flow control valve(s) and exhausted to the atmosphere through valve 160. At the instant at which operating valve 154 or 154' is released, the cylinder(s) will stop at that position. This allows for an almost infinite number of height positions attainable with the pneumatic system for the cot according to the invention. If the cylinder(s) is already fully expanded, and valve 154 or 154' is pushed, nothing will, effectively, happen.

To contract the cot, thereby either lowering the upper frame 12 relative to the ground, or raising the undercarriage 14 while the upper frame 12 is held in position, as would be desired in order to transfer cot 10 into the rear of ambulance 8, either valve 156 or 156' may be pushed. This permits pressurized flow through shuttle valve 164, thereby engaged pilot controlled valve 160 to permit pressurized flow through the normally disengaged valve 90, through valve 160, through regulator valve 166 and to the upper end of the cylinder 46 (or cylinders 126 and 128). Simultaneously, fluid, or air in this case, from the bottom end of the cylinder(s) is metered out through flow control valve 174 (or 174 and 174') and exhausted through valve 160 to the atmosphere. Flow control valve 174 (or 174 and 174', as the case may be) regulates the rate of exhaust flow from the cylinders, thereby defining the rate at which the upper frame 12 of cot 10 may be lowered, or the rate at which undercarriage 16 may be raised relative to upper frame 12. Therefore, should a pressure line break at any location in the pneumatic system, the rate at which cot 10 could drop would be fixed and would not exceed the rate at which it would be lowered with the pneumatic system active. As an additional safety feature, the flow control valves are mounted directly onto the cylinder(s).

When cot 10 is under load (i.e. supporting a patient), it may be lowered in a more efficient manner via exhaust valve 158, which merely exhausts the air from the bottom portion of the cylinder(s) to the atmosphere, without repressurizing the opposite end(s) of the cylinder(s), as would traditionally be done. A vacuum in the upper portion of the cylinder 46 (or in 126 and 128) is prevented due to the check valve 168, which permits air to enter, but not to exit from the upper portion of the cylinder(s).

It should be noted that all exhaust ports in the pneumatic system contain mufflers for the purpose of reducing the noise emitted from the escaping pressurized air. These would typically be of a cindered bronze type.

In the case of a malfunction in the pneumatic system; i.e. a ruptured pressure line, a damaged valve, and the like, the pneumatic system may be overridden by engaging valve 90. Then, if it is desired to manually raise the cot, valve 154, 154' 156 or 156' may be pushed thereby exhausting all air from the cylinder(s), permitting the cylinder(s) to be expanded freely. The cot may also be manually lowered in a similar manner by engaging first valve 90, then either valve 154, 154', 156, 156' or 158 Again for safety considerations, the rate of descent is governed at all times via the flow control valve(s) 174 (or 174 and 174') mounted directly onto the cylinder(s).

As a preferred alternative, a manual override may be achieved by discarding valve 90 from the circuit design and installing a 6-way, 2-position detent valve immediately after valve 160 across the pressure lines leading towards the top and bottom end of cylinder 46 (or cylinder 126 and 128). This valve would either allow pressurized flow to either end of the cylinder(s), or it would block off all pressurized flow from the source, and exhaust all air from the cylinder(s) to the atmosphere. Then, by engaging this valve, (not shown in FIG. 22) all air from the cylinder(s) is exhausted without the need for any other valves. This is a preferred set-up from a reliability and simplicity standpoint.

If everything described above failed (i.e. if the cot had been in an accident), the pressure lines leading to the cylinder(s) may be disconnected relatively quickly, allowing all air in the cylinder to escape to the atmosphere such that the cylinder(s) may expand and contract freely, thereby allowing the cot to be operated manually in a similar manner as compared to current cots.

The pressure source referred to above comprises a set of pressure vessels 80 (and optional pressure vessel 130) which include drain valves, relief valves and pressure gage 176. Immediately following gage 176 is a regulator valve 178 which reduces the output pressure to the desired operating pressure.

It should also be noted that the "bounce" obtained from typical pneumatic cylinders under slightly varying loads is virtually eliminated in the cot according to this invention, as the power required in the cylinder(s) to raise and lower the cot is a direct function of the sine of angle A depicted in FIGS. 4 and 15. As the cot begins to rise, angle A increases, thereby decreasing the required force in the cylinder(s) to lift the upper frame 12 relative to the lower frame 14. However, the operating pressure remains virtually a constant; therefore, at any height position above fully contracted, more force is contained within the cylinders than is required at that height. This effectively counteracts any varying load, such as an ambulance attendant applying C.P.R. to a patient. This is a very important and advantageous feature of the double parallelogram configuration described hereinabove.

Figure 20:
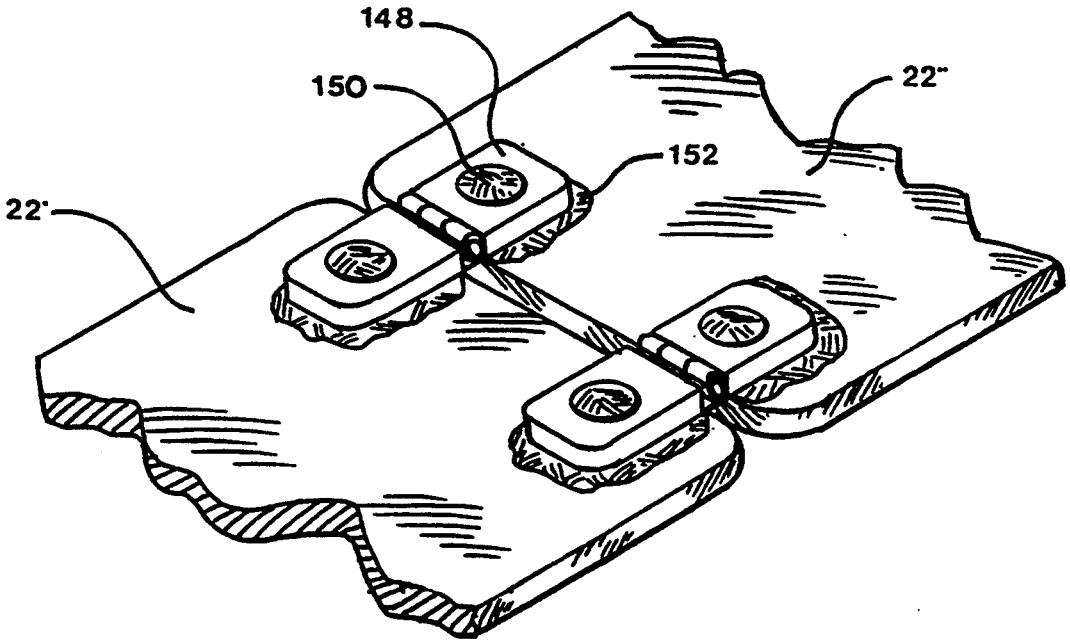
FIG. 20 is a perspective view of hinges epoxy resin bonded to patient support panels of use in a cot according to the invention.
Figure 21:
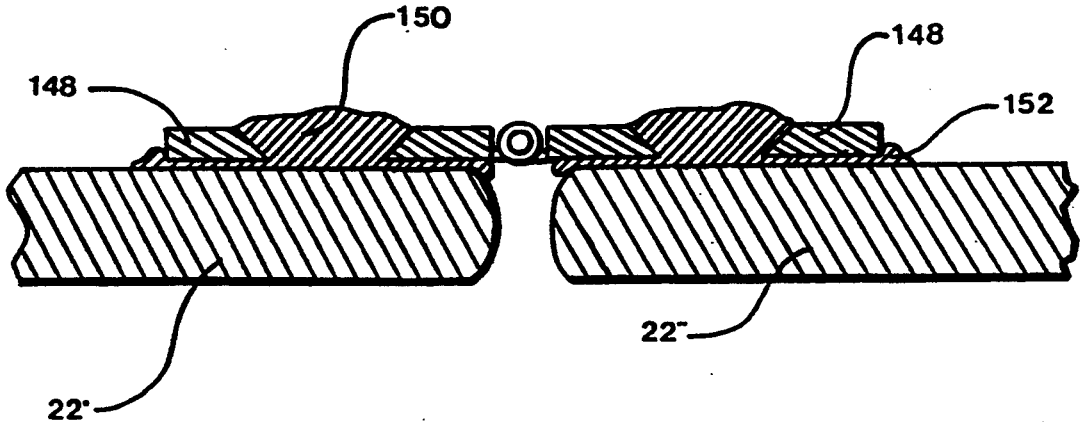
FIG. 21 is a schematic side elevational sectional view of hinges epoxy resin bonded to patient support panels of use in a cot according to the invention.

With reference to FIGS. 20 and 21 patient bed 22 comprises typical composite sandwich boards or panels 22' and 22'' interconnected by means of hinges 148. Hinges 148 are bonded to sandwich boards by means of a structural epoxy adhesive cured as an "epoxy rivet" 150 and bond 152. In a similar manner (not shown), bed surface 22 is retained at the proper locations on upper frame structure 12. In order for the above epoxy bond to break, the adhesive must fail both in shear strength and in peal strength. Such a double requirement provides the present embodiments with useful and advantageous features, by allowing for the implementation of light weight materials which might otherwise be complicated to integrate with the other structural members of the cot.

The preferred structural adhesive used in the bonding of use in this invention is a combination of an ARATHANE AW 5540 TM flexible SMC resin and HARDENER HW 5541 TM flexible SMC (Ciba-Geigy). ARATHANE AW 5540 contains methylene bis (phenyl isocyanate), prepolymer polymethylene polyphenylisocyanate, amorphous silica; and HARDENER 5541 contains polybutadiene polyol, hydroxypropyl aniline, hydrogenated terphenyls, ethyl hexadediol, amorphous silica, calcium carbonate, diamino cyclohexane. The resin and hardener ratio (by weight) is 100 parts resin to 95 parts hardener and has a working time of approximately 15 minutes after being mixed.

Thus, it can be readily seen that the ambulance cot according to the invention may be readily raised and lowered at the push of a button of the valve system and thereby eliminates the need for any heavy or awkward lifting by the attendants. The on-board pneumatic lift system essentially consists of the two main pressure vessels, either one or two pneumatic cylinders to raise and lower the cot and the two valve systems that allow the cot to be operated independently from two locations on the stretcher. An additional valve inherent in the valve system allows the loaded cot to be lowered by exhausting the two-way pneumatic cylinder to the atmosphere, rather than pressurizing the opposite end of the cylinder as is traditionally done with a two-way cylinder. This allows for significantly more cycles to be obtained per charge of the pressure vessels. The pressure vessels would typically be refilled approximately once per shift, i.e. about every 8 hours. Further, for safety reasons the pressure vessels are equipped with a relief valve for each tank. Pressure gauges for operating pressure and pressure remaining in the air tanks allow for efficient operation of the ambulance cot. The operating pressure of the pneumatic system is of the order of 100 to 150 psig. Therefore, if needed, the pressure vessels could be refilled with a typical gas station air compressor. The system is also equipped with a cylinder exhaust valve which permits a manual override of the lift system in case of any malfunction in the pneumatic components. Due to the relatively low pressure required in the pneumatic cylinder while retracting the undercarriage, regulated flow is used.

In the embodiments described, the frame structures are made of high strength aluminum alloy thin wall tubing. Clearly, alternative supporting frame work material may be used without detracting from the spirit of this invention. The weight of the ambulance cot is approximately 75–80 pounds.

Another advantage, inherent in the structure of the cot as hereinbefore described permits the front handle to not only assist in the loading and unloading of the cot from the ambulance with the above mentioned wheel assembly, but also to be telescopic, providing the cot with greater operational flexibility. In addition, the cot is operable from a minimum height of approximately 0.4 m to a height of almost 1 m. One of the important capabilities of the present invention is that the cot may be adjusted to a virtually infinite number of height positions in this range for a short duration of time—approximately 15 to 20 minutes, depending on the relative load, and may be locked in one of about fifteen different height positions if it is desired to maintain the cot at a particular height for a prolonged period of time.

As a safety feature of the preferred embodiment, two hands of the attendants are required to engage the lock mechanism. An additional safety feature of this lock mechanism, is that once it is engaged, the cot can not drop if any one of the push button valves is accidentally pushed. Furthermore, with the flow control valves mounted directly onto the pneumatic cylinder(s), in any situation, the cot may only be lowered at a fixed rate.

As may be readily understood by the skilled man, the cot may be transferred into the rear of an ambulance in one of two ways:

1) The cot is held in position by an attendant on either side of the cot in a traditional manner, at which point one of the attendants pushes a button that raises the under carriage, thereby allowing the attendants to transfer the cot into the rear of the ambulance without having to physically lift the cot.
2) With the assistance of the two small wheels positioned at the end of the front telescopic handle, the fore end of the cot may be rested in the rear of the ambulance. The aft end of the cot is held in position by an attendant who raises the under carriage by pushing a button. At this time, the cot may be rolled into the rear of the ambulance.

Although both of these methods have eliminated the need for the attendants to lift the cot, the second method is somewhat more advantageous in that it eliminates any torsional actions in the backs of the attendants while loading the cot into the ambulance. In a similar manner, the cot may be taken out of the ambulance. Hence, when handling the loaded cot, the attendants may keep their backs straight and relatively unstrained at all times, greatly reducing the risk of sustaining a back injury or exacerbating an existing one.

Although this disclosure has described and illustrated certain preferred embodiments of the invention, it is to be understood that the invention is not restricted to those particular embodiments but rather the invention includes all embodiments which are functional or mechanical equivalents of the specific embodiments featured that have been described as illustrated herein.

I claim:

1. A collapsible ambulance cot comprising an upper frame having patient support means;

a lower frame;

an intermediate frame disposed between and cooperable with said upper frame and said lower frame;

support means Comprising a frame support pivotally connected to said upper frame, and said lower frame and said intermediate frame to support said upper frame and allow separation of said upper frame from said lower frame to a selected height of said upper frame above said lower frame; and adjustable retaining means cooperable with said support means to retain said upper frame at said selected height.

2. A cot as claimed in claim 1 wherein said frame support comprises at least one pair of pivotal frame support members, each of said frame support members displaced one from the other of said frame support member and pivotally connected to said upper frame, lower frame and said intermediate frame relative one to the others, and to provide support to said upper frame.

3. A cot as claimed in claim 2 wherein each of said frame support members comprises a pivotal collapsible X-frame.

4. A cot as claimed in claim 2 comprising a first pair of said pivotal frame support members, a second pair of said pivotal frame support members and a third pivotal frame support member, wherein each of said first pair, said second and said third frame support members are so disposed as to provide support to said upper frame; and wherein each of said pivotal frame support members comprises (a) a first elongated member pivotally connected (i) at an upper part thereof to said upper frame and (ii) at a lower part thereof to said intermediate frame; and (b) a second elongated member pivotally connected (i) at an upper part thereof to said intermediate frame and (ii) at a lower part thereof to said lower frame.

5. A cot as claimed in claim 4 wherein two of said first elongated members, said upper frame and said intermediate frame define a parallelogram.

6. A cot as claimed in claim 4 wherein two of said second elongated members, said intermediate frame and said lower frame define a parallelogram.

7. A cot as claimed in claim 1 wherein said adjustable retaining means comprises a fluid actuated cylinder and piston means.

8. A cot as claimed in claim 7 further comprising retaining means selected from the group consisting of ratchet and pin retaining means and lockable telescopic tube means, cooperable with said cylinder and piston means.

9. A cot as claimed in claim 7 wherein said intermediate frame retains said cylinder and piston means.

10. A cot as claimed in claim 8 wherein said retaining means is activated by multiple-bar spring return locking means.

11. A cot as claimed in claim 8 wherein said retaining means is activated by a cable means or hydraulic fluid means.

12. A cot as claimed in claim 7 further comprising pressurized fluid activating means operable upon said cylinder and piston means by manually controllable valve means.

13. A cot as claimed in claim 12 wherein said valve means comprises a first valve means to effect piston expansion of said cylinder and piston means to effect raising of said upper frame above said lower frame; a second valve means to effect movement of said upper frame or said lower frame one towards the other, to effect either lowering of said upper frame to said lower frame, or, raising of said lower frame to said upper frame when said upper frame is maintained at a selected height above the ground; and a third valve to effect exhaustion of fluid from said cylinder.

* * * * *